US005634356A

United States Patent [19]

Agrawal et al.

[11] Patent Number: 5,634,356

[45] Date of Patent: Jun. 3, 1997

[54] PROCESS FOR INTRODUCING A MULTICOMPONENT LIQUID FEED STREAM AT PRESSURE $P_2$ INTO A DISTILLATION COLUMN OPERATING AT LOWER PRESSURE $P_1$

[75] Inventors: Rakesh Agrawal, Emmaus; Donald W. Woodward, New Tripoli, both of Pa.

[73] Assignee: Air Products and Chemicals, Inc., Allentown, Pa.

[21] Appl. No.: 563,416

[22] Filed: Nov. 28, 1995

[51] Int. Cl.[6] ..... F25J 3/00

[52] U.S. Cl. ..... 62/646; 62/924

[58] Field of Search ..... 62/646, 924

[56] References Cited

U.S. PATENT DOCUMENTS 5,157,926 10/1992 Guilleminot ..... 62/646
5,475,980 12/1995 Grenier et al. ..... 62/646

OTHER PUBLICATIONS

R. E. Latimer, "Distillation of Air" in Chemical Engineering Progress, 63(2), 35–39, (1967).

*Primary Examiner*—Ronald C. Capossela
*Attorney, Agent, or Firm*—Robert J. Wolff

[57] ABSTRACT

A process is set forth for introducing a multicomponent liquid feed stream at pressure $P_2$ into a distillation column operating at lower pressure $P_1$. The process comprises removing a split stream from the feed stream, reducing its pressure and using the resulting stream to subcool the feed stream. After being subcooled, the feed stream is also reduced in pressure and both streams are fed to different stages of the distillation column. An important embodiment of the present invention is within the standard double column air separation cycle where the multicomponent liquid stream is the crude liquid oxygen stream from the bottom of the high pressure column which must be reduced in pressure prior to its introduction into the low pressure column.

5 Claims, 5 Drawing Sheets

PROCESS FOR INTRODUCING A MULTICOMPONENT LIQUID FEED STREAM AT PRESSURE $P_2$ INTO A DISTILLATION COLUMN OPERATING AT LOWER PRESSURE $P_1$

TECHNICAL FIELD OF THE INVENTION

The present invention relates to distillation. More specifically, the present invention relates to a process for introducing a multicomponent liquid feed stream at pressure $P_2$ into a distillation column operating at lower pressure $P_1$.

BACKGROUND OF THE INVENTION

A common task encountered in distillation processes is where one must introduce a multicomponent liquid feed stream at pressure $P_2$ into a distillation column operating at lower pressure $P_1$. For example, in the state of the art double column air separation cycle, the crude liquid oxygen bottoms from the high pressure column must be reduced in pressure prior to being fed to the low pressure column for further rectification.

Typically, as shown in FIG. 1, the above noted task is accomplished by simply reducing the pressure of the multicomponent liquid feed stream across a valve prior to its introduction into the distillation column. Referring now to FIG. 1, multicomponent liquid feed stream 10 is reduced in pressure across valve V1 prior to its introduction into distillation column C1 as stream 11.

It is an object of the present invention to devise an improved scheme for accomplishing this task whereby the subsequent separation of the feed stream in the distillation column is made more efficient.

SUMMARY OF THE INVENTION

The present invention is a process for introducing a multicomponent liquid feed stream at pressure $P_2$ into a distillation column operating at lower pressure $P_1$. The process comprises removing a split stream from the feed stream, reducing its pressure and using the resulting stream to subcool the feed stream. After being subcooled, the feed stream is also reduced in pressure and both streams are fed to different stages of the distillation column. An important embodiment of the present invention is within the standard double column air separation cycle where the multicomponent liquid stream is the crude liquid oxygen stream from the bottom of the high pressure column which must be reduced in pressure prior to its introduction into the low pressure column.

DETAILED DESCRIPTION OF THE INVENTION

Figure 1:
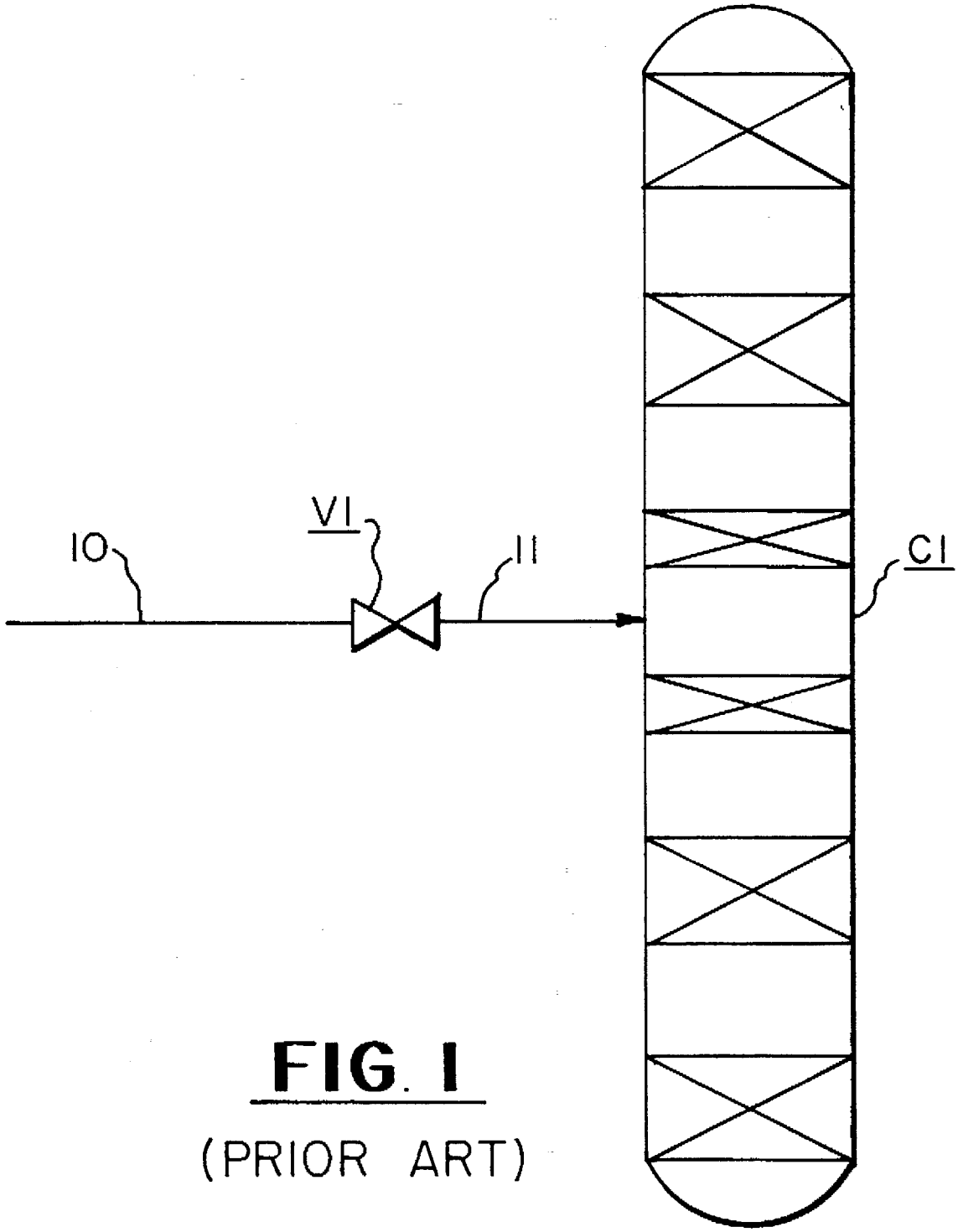
FIG. 1 (PRIOR ART)
FIG. 1 is a schematic drawing of the prior art process for introducing a multicomponent liquid feed stream at pressure $P_2$ into a distillation column operating at lower pressure $P_1$.

The present invention is a process for introducing a multicomponent liquid feed stream at pressure $P_2$ into a distillation column operating at lower pressure $P_1$. The process of the present invention is best illustrated with respect to the drawing of FIG. 2 which is a schematic drawing of the simplest embodiment of the process of the present invention.

Figure 2:
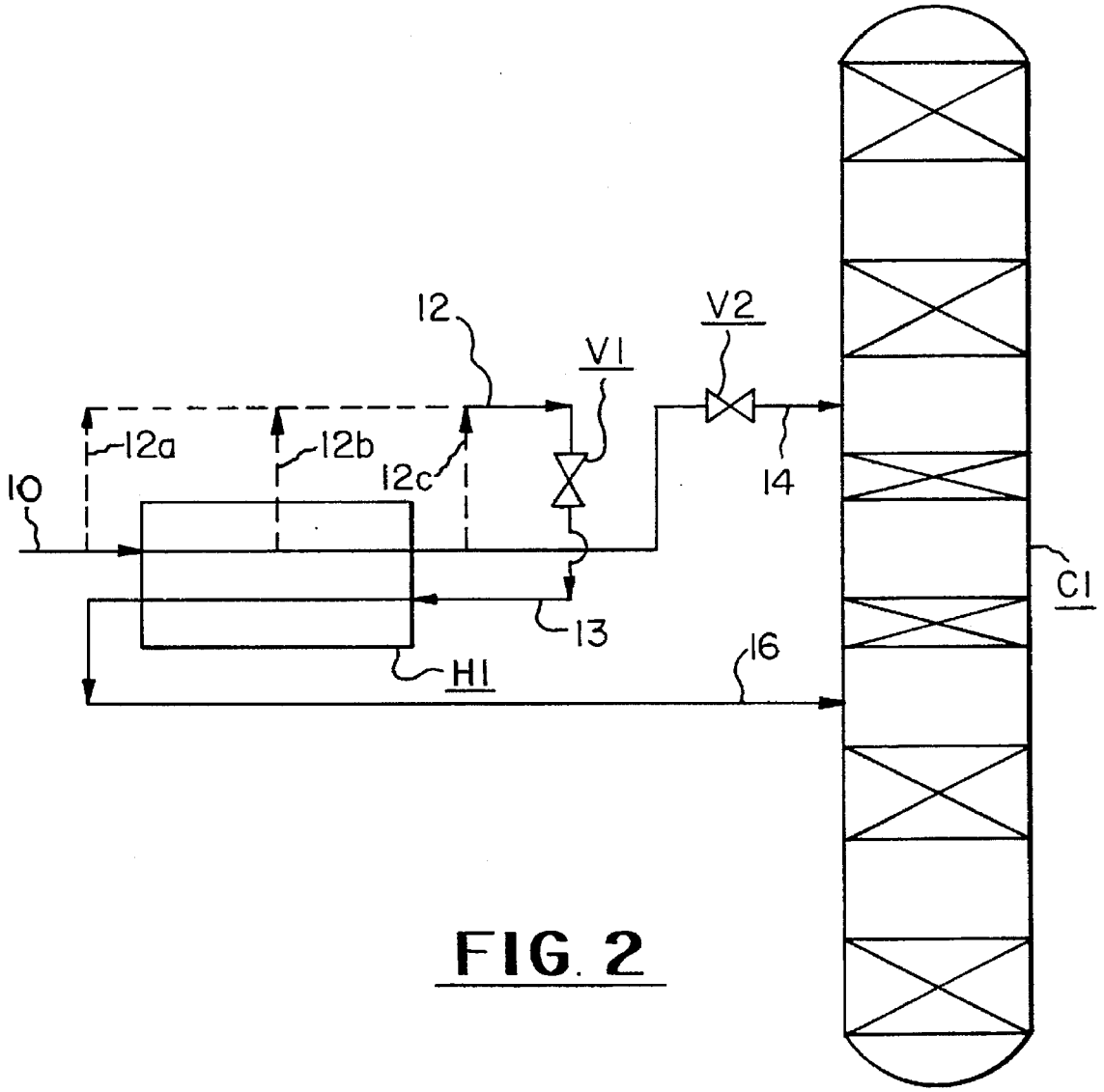
FIG. 2 is a schematic drawing depicting the simplest embodiment of the process of the present invention.

Referring now to FIG. 2, a split stream 12 is removed from multicomponent liquid feed stream 10. As represented by the dotted lines in FIG. 2, the split stream can be removed either before the subcooling of the feed stream (stream 12*a*) and/or during the subcooling of the feed stream (stream 12*b*) and/or after the subcooling of the feed stream (stream 12*c*) although, as explained later, the split stream is preferably removed from the feed stream after the subcooling of the feed stream. The pressure of the split stream is subsequently reduced across valve V1. The reduced pressure split stream (stream 13) is then indirectly heat exchanged against the feed stream in heat exchanger H1, thereby subcooling the feed stream and warming the reduced pressure split stream. After reducing the pressure of the subcooled feed stream across valve V2, both the reduced pressure, subcooled feed stream (stream 14) and the warmed, reduced pressure split stream (stream 16) are introduced into distillation column C1. As shown in FIG. 2, the introduction point of the reduced pressure, subcooled feed stream (stream 14) is at least one stage above the introduction point of the warmed, reduced pressure split stream (stream 16).

The skilled practitioner will appreciate the following aspects of the present invention as depicted in FIG. 2's embodiment thereof:

1. Split stream removal location. As noted above, the split stream is preferably removed from the feed stream after the subcooling of the feed stream as represented by stream 12*c* in FIG. 2. This has to do more with practical limitations associated with the heat exchanger as opposed to any thermodynamic driving force. By removing the slip stream after it has been subcooled in the heat exchanger, there will be less flashing of the slip stream into the vapor phase when the slip stream is subsequently flashed/reduced in pressure across valve 1 and warmed against the subcooling feed stream in the heat exchanger. This, in turn, translates into a simpler heat exchanger design.

2. Valve vs. dense fluid expander for accomplishing pressure reduction. The respective pressure reductions of the split stream and the feed stream in FIG. 2 are performed across valves. In the interest of gaining thermodynamic efficiency by performing these pressure reductions largely at constant entropy instead of at constant enthalpy, one could conceivably replace one or both of these valves with dense fluid expanders. Such efficiency gain, however, would come at the expense of increased capital and operating complexity.

3. Pressure of streams following their respective pressure reductions. The pressure of the split stream and feed stream following their respective pressure reductions will generally be the operating pressure of the distillation column plus the expected pressure drop between the valve/expander at issue and the column. In the case of the split stream, this expected pressure drop must take into account the pressure drop across the heat exchanger. Thus the pressure of the split stream following its pressure reduction will generally be slightly higher than the pressure of the feed stream following its pressure reduction.

Figure 3:
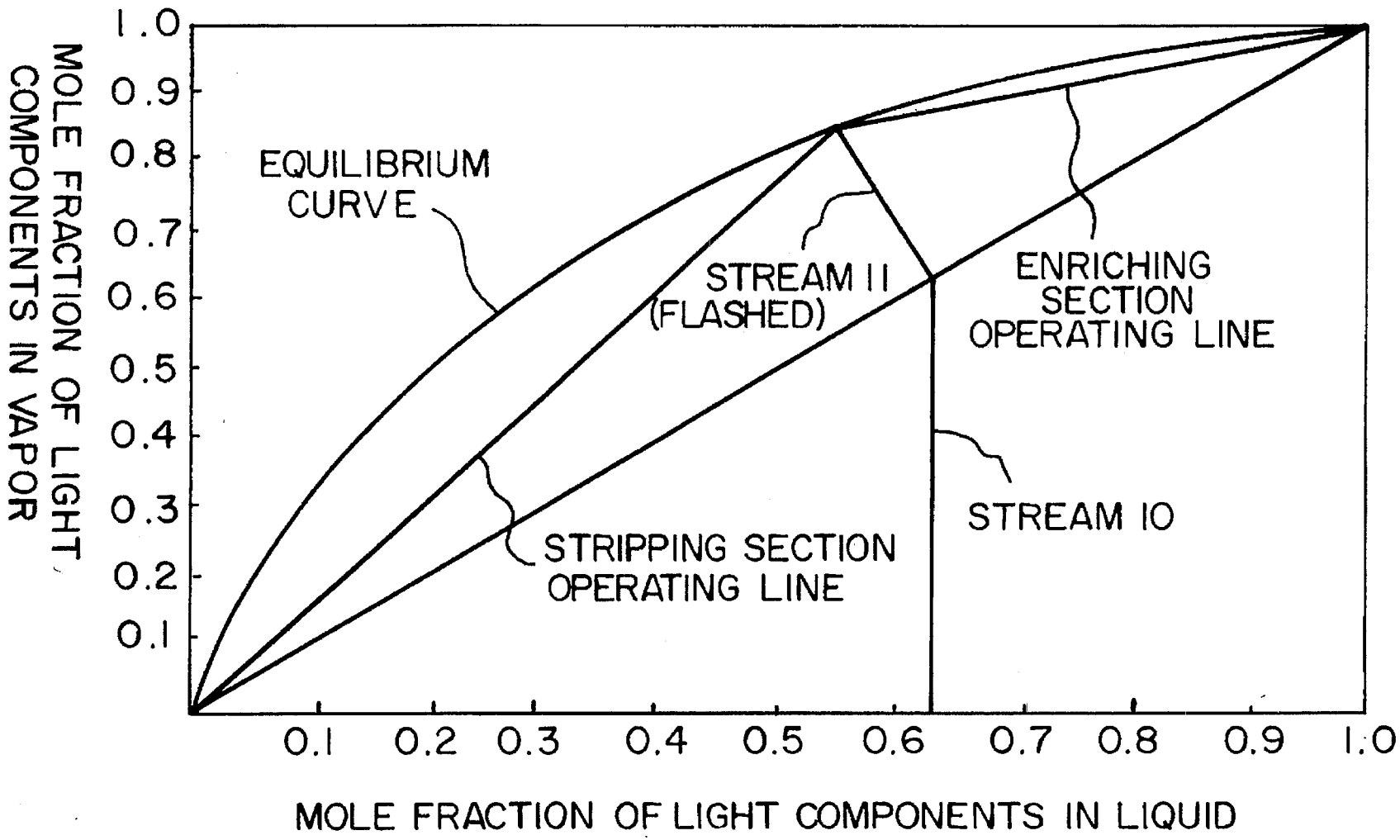
FIG. 3 is a generalized McCabe Theile diagram for FIG. 1's prior art distillation process.
Figure 4:
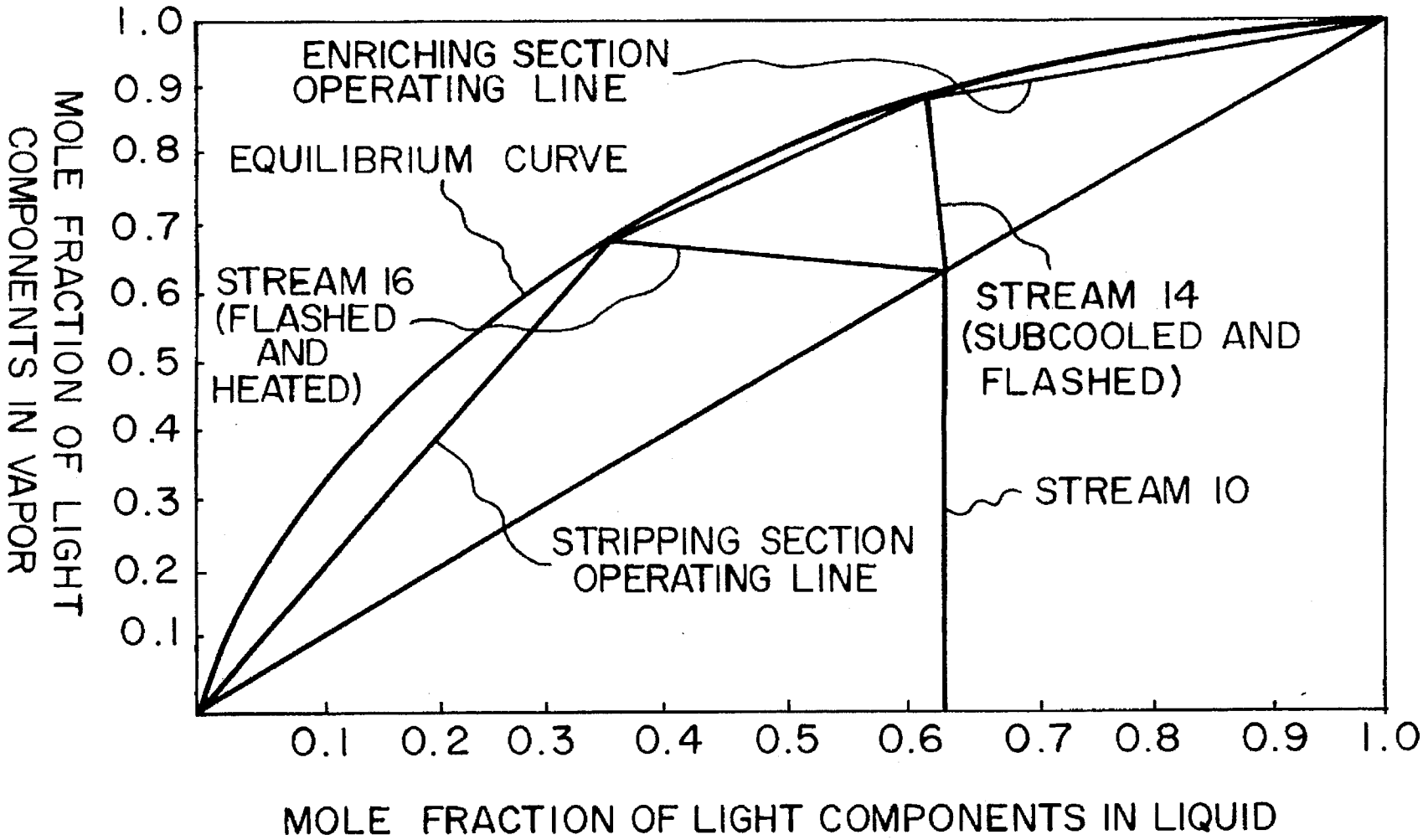
FIG. 4 is a generalized McCabe Thelie diagram for FIG. 2's distillation process which, when compared to FIG. 3, graphically illustrates the improvement of the present invention over the prior art.

The benefit of the present invention is that, as compared to the prior art method as depicted in FIG. 1, the subsequent separation of the feed stream in the distillation column is made more efficient. This increased efficiency of separation is graphically illustrated by generalized McCabe Thelie diagrams for the distillation processes in FIGS. 1 and 2 as are shown, respectively, in FIGS. 3 and 4. Note how much closer the operating lines are to the equilibrium curve in FIG. 4 as compared to FIG. 3. (In a McCabe Thelie diagram, the closer the operating lines are to the equilibrium curve, the more efficient the separation becomes). This is not only because there are two distinct feed lines in FIG. 4 (as compared to a single feed line in FIG. 3), but also because the slope of the feed lines in FIG. 4 have been favorably manipulated by the present invention's act of transferring refrigeration between the two streams. By subcooling feed stream 14, the slope of its feed line in FIG. 4 is rotated clockwise as compared to the single feed line in FIG. 3. (Note that the slope of subcooled feed line 14 is almost vertical in FIG. 4 since it is close to its bubble point temperature after being flashed/reduced in pressure in FIG. 2; post-flash temperatures colder than feed line 14's bubble point temperature would rotate the slope of feed line 14 even further in the clockwise direction). Similarly, by warming split stream 16, its feed line is rotated counterclockwise as compared to the single feed line in FIG. 3. (Note that the slope of warmed feed line 16 is almost horizontal in FIG. 4 since it is dose to its dew point temperature after being flashed/reduced in pressure in FIG. 2; post-flash temperatures warmer than feed line 16's dew point would rotate the slope of feed line 16 even further in the counterclockwise direction). In terms of maximizing the efficiency of the separation, the optimum slopes of the feed lines are those slopes which minimize the area between the operating lines and the equilibrium curve. The optimum slopes of the feed lines are dependent on the specific example, especially with respect to the shape of the equilibrium curve.

The improved efficiency of separation resulting from the present invention as discussed above translates into a better separation (i.e. improved product purities and recoveries) using the same power (i.e. the same boil-up and reflux requirements) and the same number of equilibrium stages in the distillation column. Conversely, the improved ease of separation can translate into an equivalent separation but with a reduction in power and/or the number of stages.

An important embodiment of the present invention is within the standard double column air separation cycle where the multicomponent liquid stream is the crude liquid oxygen stream from the bottom of the high pressure column which must be reduced in pressure prior to its introduction into the low pressure column. This embodiment is depicted in FIG. 5.

Figure 5:
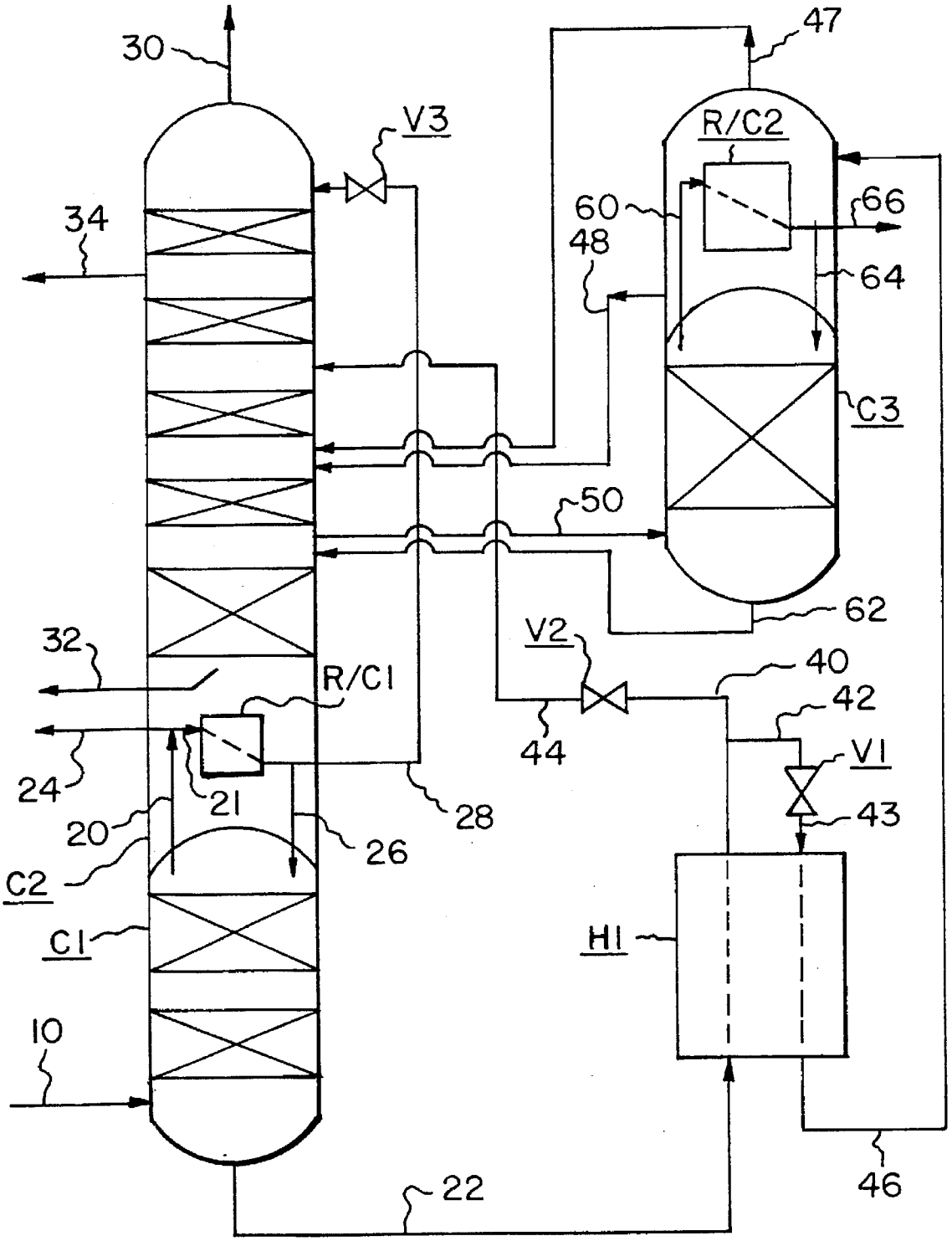
FIG. 5 is a schematic diagram depicting a second embodiment of the present invention wherein the present invention is incorporated into the state of the art double column air separation cycle.

Referring now to FIG. 5, an air feed (stream 10) which has been compressed to an elevated pressure, cleaned of impurities which will freeze out at cryogenic temperatures and cooled to near its dew point is fed to a distillation column system comprising high pressure column C1, low pressure column C2 and crude argon column C3. In the interests of simplifying the drawing of FIG. 5, the operations relating to the above noted compression, cleaning and cooling of the air feed have been omitted from FIG. 5. As is well known to those skilled in the art:

(i) the compression of the feed stream is typically performed in multiple stages with interstage cooling against cooling water;

(ii) the cleaning of impurities which will freeze out at cryogenic temperatures (such as water and carbon dioxide) is typically performed by a process which incorporates an adsorption mole sieve bed; and (iii) the cooling of the air feed down to its dewpoint is typically performed by heat exchanging the pressurized air feed in a front end main heat exchanger against the gaseous product streams which are produced from the process at cryogenic temperatures.

Continuing the reference to FIG. 5, the air feed is specifically fed to high pressure column C1 in which the air feed is rectified into an intermediate gaseous nitrogen overhead (stream 20), a portion of which is removed as a product stream (stream 24), and the crude liquid oxygen bottoms (stream 22). As per the process of 5 the present invention, a split stream (stream 42) is removed form the crude liquid oxygen bottoms, reduced in pressure across valve V1 and the resulting reduced pressure split stream (stream 43) is heat exchanged against the crude liquid oxygen bottoms in heat exchanger H1. The pressure of the subcooled crude liquid oxygen bottoms (stream 40) is reduced in pressure across valve V2 and the resulting reduced pressure, subcooled crude liquid oxygen bottoms (stream 44) is fed to low pressure column C2 in which it is distilled into a final gaseous nitrogen overhead (stream 30) and a final liquid oxygen bottoms which collects in the sump of the low pressure column. A gaseous oxygen product stream (stream 32) and a waste stream (stream 34) are also removed from the low pressure column.

The high pressure and low pressure columns are thermally integrated in that a portion of the intermediate gaseous nitrogen overhead from the high pressure column (stream 21) is condensed in reboiler/condenser R/C I against a vaporizing portion of the final liquid oxygen bottoms. A first portion of the condensed intermediate gaseous nitrogen overhead (stream 26) is used to provide reflux for the high pressure column while a second portion (stream 28) is used to provide reflux for the low pressure column after being reduced in pressure across valve V3.

An argon-containing gaseous side stream (stream 50) is removed from the low pressure column and fed to the crude argon column in which it is rectified into an argon-rich gaseous overhead (stream 60) and an argon-lean bottoms liquid (stream 62). The argon-lean bottoms liquid is returned to a suitable location in the low pressure column. The argon-rich gaseous overhead is condensed in reboiler/condenser R/C 2 against the warmed reduced pressure split stream (stream 46). A portion of the condensed argon-rich overhead is returned as reflux to the argon side-arm column (stream 64) while the remaining portion is recovered as a product stream (stream 66). Both the vapor component of the further warmed split stream (stream 47) and the liquid component (stream 48) are fed to a suitable location in the low pressure column.

The skilled practitioner will appreciate the following aspects of the present invention when it is incorporated into a more comprehensive distillation operation such as depicted in FIG. 5's embodiment thereof:

(1) Subcooling of other additional streams by the reduced pressure split stream. When the process of the present invention is integrated into a more comprehensive distillation operation such as shown in FIG. 5, there will often be additional streams that can also be advantageously integrated into the present invention's heat exchange step such that these additional streams are also cooled or subcooled by the reduced pressure split stream of the present invention. For example, although not shown in FIG. 5, the nitrogen reflux stream to the low pressure column (stream 28) could be subcooled by the reduced pressure split stream (stream 43). Similarly, a turbo expanded portion of the air feed could be cooled by the reduced pressure split stream (stream 43) prior to being fed to the low pressure column.

(2) Thermal integration of the present invention's heat exchanger with the prior art subcoolers. In the interests of simplifying the drawing of FIG. 5, omitted from FIG. 5 are the well known prior art subcooling heat exchanger(s) which transfer low temperature refrigeration from various product streams (such as streams 30 and 34 in FIG. 5) to various low pressure column feed streams (such as streams 22 and 28 in FIG. 5). It should be noted that the present invention's heat exchanger can be integrated with these subcoolers to form a single heat exchanger as can be easily designed by one skilled in the art.

We claim:

1. A process for introducing a multicomponent liquid feed stream at pressure $P_2$ into a distillation column operating at lower pressure $P_1$, said process comprising the steps of:

(a) removing a split stream from the feed stream;

(b) reducing the pressure of the split stream;

(c) heat exchanging the reduced pressure split stream against the feed stream, thereby subcooling said feed stream and warming said reduced pressure split stream;

(d) reducing the pressure of the subcooled feed stream; and (e) introducing the reduced pressure, subcooled feed stream and the warmed, reduced pressure split stream into the distillation column wherein the introduction point of the reduced pressure, subcooled feed stream is at least one stage above the introduction point of the warmed, reduced pressure split stream.

2. The process of claim 1 wherein the split stream is removed from the feed stream after the subcooling of the feed stream.

3. The process of claim 1 wherein:

(i) the reduction of the pressure of the split stream in step (b) is performed across a first valve;

(ii) the heat exchange in step (c) is performed in a heat exchanger; and (iii) the reduction of the pressure of the subcooled feed stream in step (d) is performed across a second valve.

4. The process of claim 1 wherein the multicomponent liquid feed stream is a crude liquid oxygen stream produced in a cryogenic distillation process for the separation of an air feed using a multiple distillation column system comprising a high pressure column and a low pressure column and wherein said crude liquid oxygen stream is more specifically withdrawn from the bottom of said high pressure column and subsequently introduced into said low pressure column and wherein said distillation column operating at pressure $P_1$ is said low pressure column.

5. The process of claim 4 wherein the multiple column distillation system further comprises a crude argon column having a condensing duty and wherein, prior to introducing the crude liquid oxygen stream into the low pressure column, the crude liquid oxygen stream is used to satisfy said crude argon column condensing duty.

* * * * *